US008976102B2

(12) United States Patent
Wang

(10) Patent No.: US 8,976,102 B2
(45) Date of Patent: Mar. 10, 2015

(54) TIMING CONTROLLER UTILIZED IN DISPLAY DEVICE AND METHOD THEREOF

(75) Inventor: Shih-Chung Wang, Hsinchi Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 263 days.

(21) Appl. No.: 12/760,703

(22) Filed: Apr. 15, 2010

(65) Prior Publication Data

US 2011/0025732 A1 Feb. 3, 2011

(30) Foreign Application Priority Data

Aug. 3, 2009 (TW) ..... 098126060 A

(51) Int. Cl.

| | |
|---|---|
| ***G09G 3/36*** | (2006.01) |
| ***G09G 5/18*** | (2006.01) |
| ***G09G 5/02*** | (2006.01) |
| ***G09G 5/10*** | (2006.01) |
| *G09G 3/34* | (2006.01) |

(52) U.S. Cl.

CPC ..... *G09G 5/18* (2013.01); *G09G 3/3406* (2013.01); *G09G 3/3611* (2013.01); *G09G 5/02* (2013.01); *G09G 5/10* (2013.01); *G09G 2320/0276* (2013.01); *G09G 2320/0666* (2013.01); *G09G 2340/0428* (2013.01); *G09G 2340/0435* (2013.01); *G09G 2360/16* (2013.01); *G09G 2370/08* (2013.01)

USPC ..... 345/99; 344/103

(58) Field of Classification Search

CPC ..... G09G 3/3611

USPC ..... 345/99, 103

See application file for complete search history.

(56) References Cited

U.S. PATENT DOCUMENTS

| | | | | |
|---|---|---|---|---|
| 7,782,398 | B2 * | 8/2010 | Chan et al. | 348/553 |
| 7,843,420 | B2 * | 11/2010 | Chen et al. | 345/99 |
| 7,916,111 | B2 * | 3/2011 | Kim et al. | 345/99 |
| 7,965,283 | B2 * | 6/2011 | Umezaki | 345/204 |
| 7,982,756 | B2 * | 7/2011 | Chou et al. | 345/690 |
| 8,194,019 | B2 * | 6/2012 | Tomizawa et al. | 345/88 |
| 2002/0126077 | A1 * | 9/2002 | Baek, II | 345/87 |
| 2003/0071779 | A1 * | 4/2003 | Lee et al. | 345/99 |
| 2004/0041918 | A1 | 3/2004 | Chan et al. | |
| 2004/0246267 | A1 * | 12/2004 | Oohara | 345/591 |

(Continued)

FOREIGN PATENT DOCUMENTS

TW I261796 9/2006

OTHER PUBLICATIONS

Taiwan Intellectual Property Office, Office Action, Mar. 21, 2013, Taiwan.

*Primary Examiner* — Roy Rabindranath

(74) *Attorney, Agent, or Firm* — WPAT, PC; Justin King

(57) ABSTRACT

A timing controller utilized in a display device includes an image processing circuit, a luminance adjusting circuit, a data converting circuit and a driving signal generating circuit. The image processing circuit performs image processing on image data of an image signal. The luminance adjusting circuit adjusts luminance of the processed image data according to a luminance characteristic of the display panel of the display device. According to a pixel arrangement of the display panel, the data converting circuit converts the adjusted image data to display data provided to a driving circuit of the display panel. The driving signal generating circuit generates a driving signal to control the driving circuit according to a synchronous signal of the image signal.

13 Claims, 5 Drawing Sheets

(56) References Cited

U.S. PATENT DOCUMENTS

| | | | | |
|---|---|---|---|---|
| 2005/0104837 | A1* | 5/2005 | Baik et al. | 345/99 |
| 2007/0052735 | A1* | 3/2007 | Chou | 345/690 |
| 2008/0111782 | A1* | 5/2008 | Shin et al. | 345/99 |
| 2008/0122813 | A1 | 5/2008 | Kim et al. | |
| 2009/0015536 | A1* | 1/2009 | Takeoka et al. | 345/99 |
| 2009/0021501 | A1 | 1/2009 | Umezaki | |
| 2009/0040167 | A1* | 2/2009 | Sun | 345/99 |

* cited by examiner

TIMING CONTROLLER UTILIZED IN DISPLAY DEVICE AND METHOD THEREOF

CROSS REFERENCE TO RELATED PATENT APPLICATION

This patent application is based on Taiwan, R.O.C. patent application No. 098126060 filed on Aug. 3, 2009.

FIELD OF THE INVENTION

The present invention relates to a timing control mechanism utilized in a display device, and more particularly, to a timing controller utilized in a display device and a method thereof.

BACKGROUND OF THE INVENTION

Generally, for that a resolution of a display panel of a current portable display device (e.g., a notebook) is constant, a graphic card is designed as directly outputting an image data with a constant resolution to the display panel without performing any image scaling or image processing during the transmission. In other words, a user is only allowed with performing image processing via a built-in VGA card to achieve an equivalent effect in adjusting characteristics of the display panel of the portable display device. However, as complexity of image data grows and a display panel becomes more and more mature day by day, the foregoing adjusting approach gradually becomes inadequate in meeting user (observer) requirements. Therefore, it is necessary to provide a display mechanism utilized in a portable display device to meet user requirements.

SUMMARY OF THE INVENTION

Therefore, one object of the present invention is to provide a timing controller utilized in a display device and a method thereof to solve the abovementioned problem. The timing controller integrates at least one of an image processing circuit or a backlight control circuit to generate images that meet observer requirements.

According to an embodiment of the present invention, a timing controller capable of controlling a driving circuit coupled to a display panel provided with a luminance characteristic and a pixel arrangement and processing an image signal provided with image data and a synchronous signal is provided. The timing controller comprises an image processing circuit, a luminance adjusting circuit, a data converting circuit and a driving signal generating circuit. The image processing circuit processes the image data. The luminance adjusting circuit adjusts luminance of the processed image data according to the luminance characteristic. The data converting circuit converts the adjusted image data to display data provided to the driving circuit according to the pixel arrangement. The driving signal generating circuit generates a driving signal according to the synchronous signal of the image signal to control the driving circuit.

According to another embodiment of the present invention, a timing control and image processing method capable of controlling a driving circuit coupled to a display panel provided with a luminance characteristic and a pixel arrangement and processing an image signal provided with image data and a synchronous signal is provided. The method comprises performing image processing on the image data; adjusting luminance of the processed image data according to the luminance characteristic; converting the adjusted image data to display data provided to the driving circuit according to the pixel arrangement; and generating a driving signal to control the driving circuit according to the synchronous signal.

According to another embodiment of the present invention, a timing controller, capable of controlling a driving circuit and a backlight module which are coupled to a display panel provided with a luminance characteristic and a pixel arrangement and processing an image signal provided with image data and a synchronous signal, is provided. The timing controller comprises a backlight control circuit, a luminance adjusting circuit, a data converting circuit and a driving signal generating circuit. The backlight control circuit generates a backlight control signal to the backlight module according to the image data. The luminance adjusting circuit adjusts luminance of the image data according to the luminance characteristic. The data converting circuit converts the adjusted image data to display data provided to the driving circuit according to the pixel arrangement. The driving signal generating circuit generates a driving signal according to the synchronous signal of the image signal to control the driving circuit.

DETAILED DESCRIPTION OF THE PREFERRED EMBODIMENT

Figure 1:
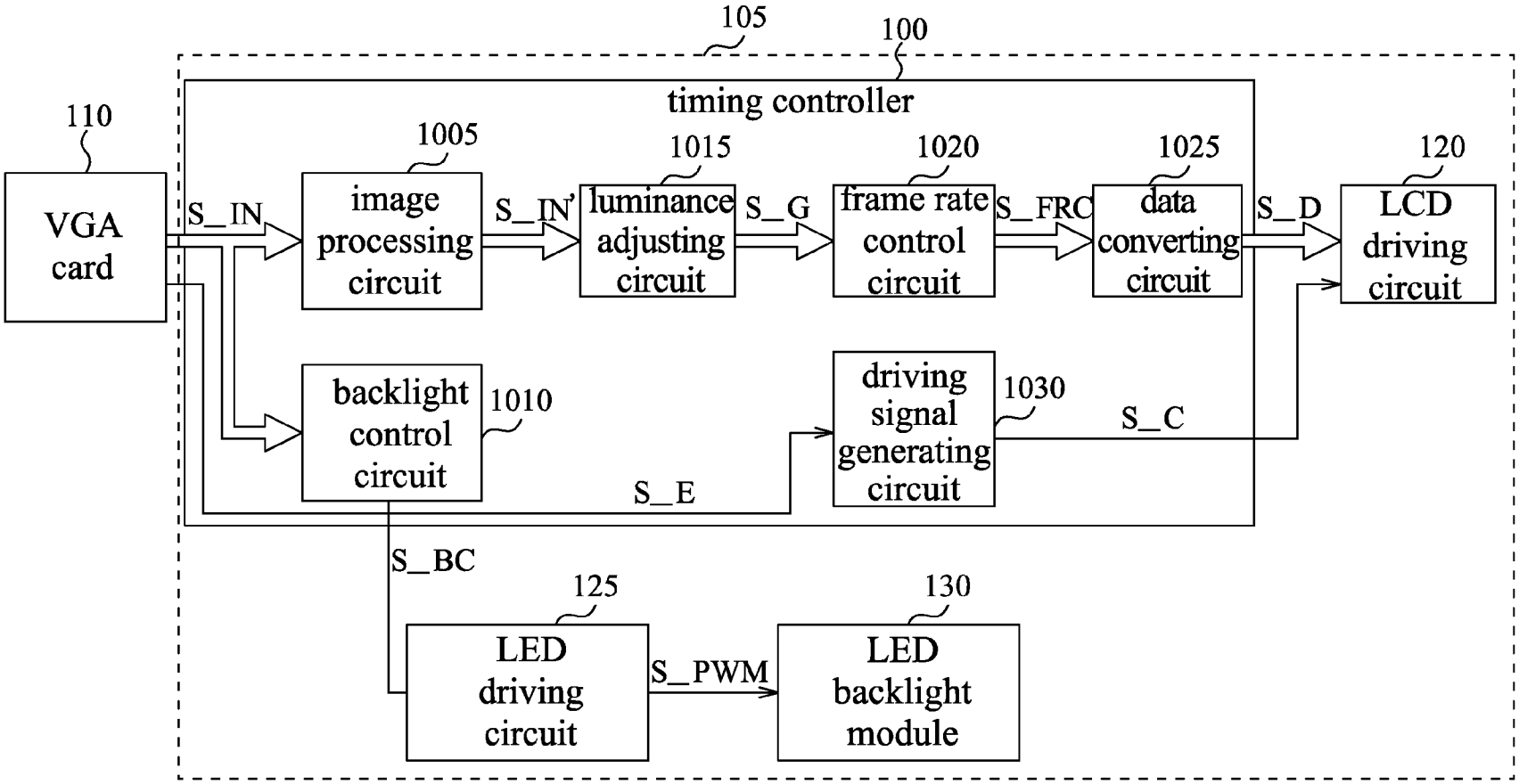
FIG. 1 is a block diagram of a timing controller utilized in a display device in accordance with an embodiment of the present invention.

Refer to FIG. 1 showing a block diagram of a timing controller 100 utilized in a display device 105 in accordance with an embodiment of the present invention. The display device 105 may be built in a notebook or a portable electronic device. In addition to the display device 105, the notebook (or the portable electronic device) further comprises a video graphic array (VGA) card 110 commonly referred to as a VGA controller. In practice, the display device 105 comprises a display panel, which is not illustrated in FIG. 1 and can be a liquid crystal display (LCD) panel. The display device 105 further comprises a timing controller 100, an LCD driving circuit 120, a light emitting diode (LED) driving circuit 125 and an LED backlight module 130.

The timing controller 100 comprises an image processing circuit 1005, a backlight control circuit 1010, a luminance adjusting circuit 1015, a frame rate control circuit 1020, a data converting circuit 1025, and a driving signal generating circuit 1030. In particular, the image processing circuit 1005 receives an image signal from the VGA card 110 and performs image processing on an image data S_IN of the image data to generate processed image data S_IN'. The luminance circuit 1015, coupled to the image processing circuit 1005, adjusts luminance of the processed image data S_IN' according to a luminance characteristic of the display panel to generate adjusted image data S_G. The frame rate control circuit 1020, coupled to the luminance adjusting circuit 1015, performs frame rate control processing on the adjusted image data S_G to generate frame rate processed image data S_FRC. The data converting circuit 1025, coupled to the frame rate control circuit 1020, converts the frame rate processed image data S_FRC to display data S_D according to a pixel arrangement of the display panel. The display data S_D needs to conform to a data format of the display panel. In particular, the display data S_D is accurately transmitted to a driving circuit of the display panel in order to transmit the pixel data to a corresponding pixel position on the display panel. For example, the data converting circuit 1025 directly converts the frame rate processed image data S_FRC to the display data S_D. The driving signal generating circuit 1030 generates a plurality of driving signals S_C according to a synchronous signal S_E of the foregoing image signal to control the LCD driving circuit 120. For example, the driving signals S_C comprise a horizontal start signal, a data load signal, a vertical start signal and a gate enable signal.

Figure 2:
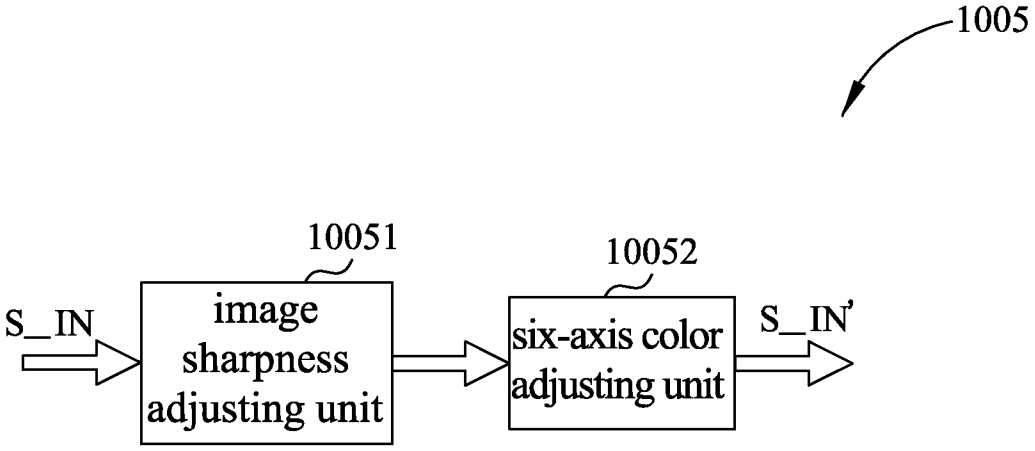
FIG. 2 is a block diagram of an image processing circuit in accordance with the embodiment illustrated in FIG. 1.

In this embodiment, image processing performed by the image processing circuit 1005 is not limited to one approach. For example, the image processing circuit 1005 can comprise a component for adjusting image value, e.g., an image sharpness adjusting unit and/or a six-axis color adjusting unit. That is, the image processing mechanism may comprise an image sharpness adjusting and/or six-axis color adjusting processing. Refer to FIG. 2 showing a block diagram of an image processing circuit in accordance with an embodiment illustrated in FIG. 1. The image processing circuit 1005 comprises an image sharpness adjusting unit 10051 and a six-axis color adjusting unit 10052. The image sharpness adjusting unit 10051 performs peaking on the image data S_IN to sharpen edges of objects in an image and thus enhances visual effects of the edges of the objects in the image. For example, the image sharpness adjusting unit 10051 removes low frequency components of the image data S_IN via a high pass filter to keep high frequency components that emphasize image edges. In another aspect, the six-axis color adjusting unit 10052 independently adjusts chromaticity and saturation of red/green/blue/cyan/magenta/yellow (R/G/B/C/M/Y) colors in the image data S_IN to generate the processed image data S_IN', such that colors are adjusted more accurately and the R/G/B/C/M/Y colors become more smooth. The six-axis color adjusting unit 10052 respectively adjusts luminance, contrast, chromaticity and saturation of each of the colors, so that a color in one axis becomes more appealing to human eyes. For example, chromaticity of the green axis is adjusted to render a more intense green color to human eyes. In other words, a user may define a predetermined personal color value by operating the six-axis color adjusting unit 10052. Since a conventional portable electronic device (e.g. a notebook) does not have capabilities of the image processing circuit 1005, an advantage of a notebook with the foregoing timing controller 100 is that manufacturers may provide readily adjusted screen display characteristics of a notebook by performing image processing via the image processing circuit 1005 of the timing controller 100 before leaving the factory. In contrast, since a timing controller of a conventional notebook is not provided with any image processing circuit, display characteristics of the conventional notebook cannot be adjusted before leaving the factory. Therefore, the timing controller 100 described in this embodiment is regarded as an intelligent timing control device.

It is to be noted that various display panels have different luminance characteristics, i.e., different display panels may generate different luminosities (i.e., light intensities) with respect to a same input voltage. Thus, the luminance adjusting circuit 1015 adjusts pixel data (i.e., gray levels) of the processed image data S_IN' according to a luminance characteristic of a current display panel, so that a back-end digital-to-analog converter (not shown in FIG. 1) of the timing controller 100 converts the adjusted pixel data to an appropriate display driving voltage for driving a display panel (e.g. an LCD panel). At this point, the luminance adjusting circuit 1015 can be a gamma adjusting circuit for correspondingly adjusting gamma value according to a gamma characteristic of the display panel; that is, the luminance adjusting circuit 1015 adjusts gamma value of the processed image data S_IN' to generate the adjusted image data S_G. After the luminance adjusting circuit 1015 generates the adjusted image data S_G, the frame rate control circuit 1020 performs frame rate control processing on the adjusted image data S_G to generate the frame rate processed image data S_FRC.

The frame rate control circuit 1020 is for controlling frame conversion or frame rate to allow human eyes to perceive different colors based on a visual persistence characteristic of human eyes. For example, when two types of colors converts from one to the other at a high speed, gradient colors between the two colors are observed by human eyes. Therefore, the frame rate control circuit 1020 controls a frame conversion speed or a frame rate to display more colors under a condition that bits of the image data are limited. In a practical application, when the image data of R, G and B colors are respectively 6 bits, a display effect of 8-bit R, G and B colors may be achieved by the frame rate control circuit 1020.

Figure 3:
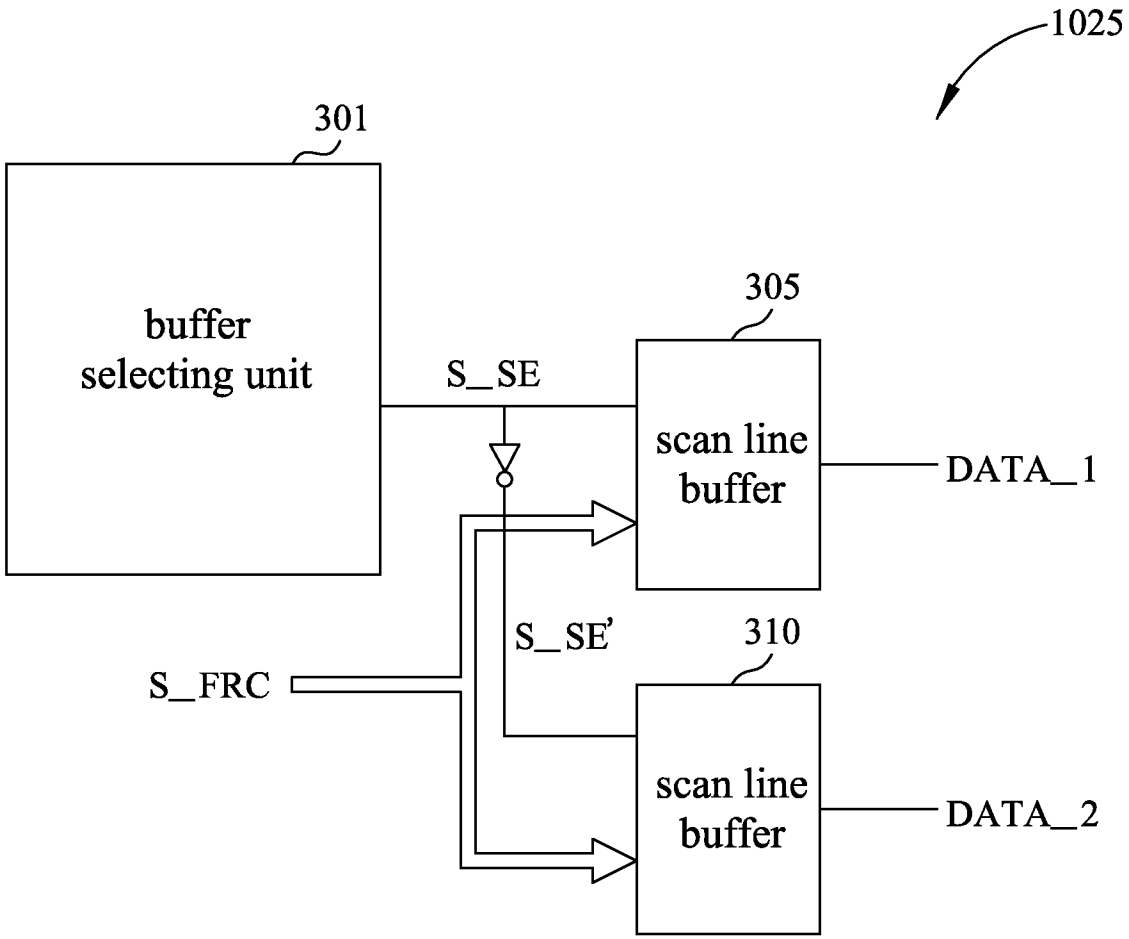
FIG. 3 is a block diagram of a data converting circuit in accordance with the embodiment illustrated in FIG. 1.

The data converting circuit 1025 converts the image data to an appropriate format according to a pixel arrangement of an LCD panel. In this embodiment, when RGB sub-pixels of each pixel on the LCD panel are arranged in a vertical manner (e.g., the RGB sub-pixels are arranged vertically as R, G, and B in sequence), the number of data driving circuits needed by the LCD driving circuit 120 is reduced to one-third, and the data converting circuit 1025 correspondingly converts the image data to an appropriate format that conforms to requirements of the LCD panel. Refer to FIG. 3 showing a block diagram of a data converting circuit 1025 in accordance with an embodiment of the present invention. In this embodiment, the data converting circuit 1025, comprising a buffer selecting unit 301 and two scan line buffers 305 and 310, processes sequences of image data for different display panels according to the number of driving circuits of each display panel. The data converting circuit 1025 converts consecutive frame rate processed image data S_FRC to data to be displayed on the display panel, i.e., the display data S_D. For example, pixels of a display area on a display panel are divided into two groups (e.g., pixels in the left half of a screen and pixels in the right half of the screen), which are driven by two different groups of driving circuits. The scan line buffers 305 and 310 are for buffering the frame rate processed image data S_FRC. For example, the buffer selecting unit 301 outputs a selecting signal S_SE and generates another selecting signal S_SE' via an inverter, and through the two selecting signals S_SE and SE_SE' that select only one of the scan line buffers 305 and 310 at a time, data buffering is performed on the selected line buffer (i.e., the scan line buffer 305 or the scan line buffer 310), so that different parts of the data are stored into different scan line buffers. For example, a first part DATA_1 and a second part DATA_2 of the frame rate processed image data S_FRC are respectively stored into the scanning line buffers 305 and 310, which respectively output the first part DATA_1 and the second part DATA_2 to the foregoing two groups of driving circuits. Under a condition that the display panel has a high resolution, two groups of driving circuits for driving the display panel can reduce operation frequencies of the driving circuits. In addition, the data converting circuit 1025 is not limited to comprising only two scan line buffers (components 305 and 310). In another embodiment, the data converting circuit 1025 may comprise a plurality of scan lines, e.g., three or four scan line buffers, as also being within the scope and spirit of the present invention. As mentioned above, the data converting circuit 1025 is properly designed with respect to characteristics of a display panel of a portable electronic device (e.g., a notebook), and designs of the data converting circuit 1025 may be varied to adapt to different types of image data driving approaches of a display panel of the notebook if required. Therefore, manufacturers may implement corresponding designs of the data converting circuit 1025 for display panels with different characteristics before notebooks leaving the factory.

Figure 4:
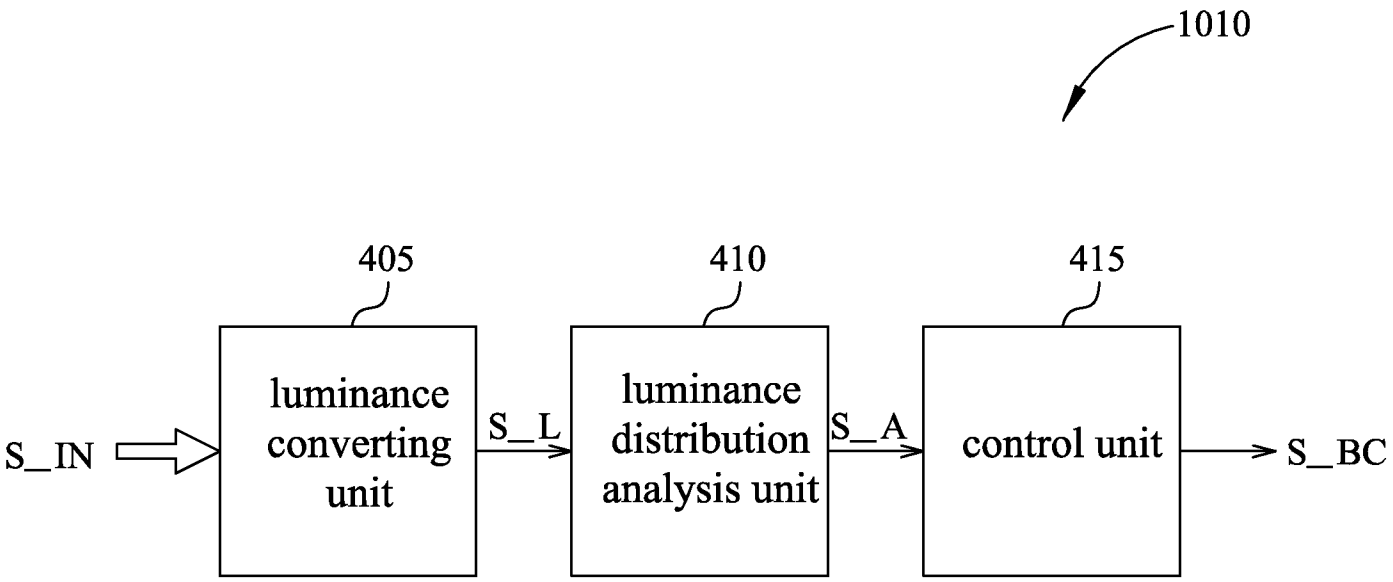
FIG. 4 is a block diagram of a backlight control circuit in accordance with the embodiment illustrated in FIG. 1.

Refer to FIG. 4 showing a block diagram of a backlight control circuit in accordance with the embodiment illustrated in FIG. 1. The backlight control circuit 1010 receives the image data S_IN and generates at least one backlight control signal S_BC according to the image data S_IN to control a backlight module (not shown in FIG. 1) of the display device 105, so as to dynamically control the backlight. For example, the backlight control circuit 1010 comprises a luminance converting unit 405, a luminance distribution analysis unit 410, and a control unit 415. The luminance converting unit 405 receives the image data S_IN and generates a luminance signal S_L corresponding to the image data S_IN. The luminance distribution analysis unit 410, coupled to the luminance converting unit 405, analyzes the luminance signal S_L to generate a luminance distribution signal S_A. The control unit 415, coupled to the luminance analysis unit 410, generates a backlight control signal S_BC according to the luminance distribution signal S_A to control a backlight module of the display device 105.

An analysis approach of the luminance distribution unit 410 is analyzing and calculating an average luminance value of frames of the image data S_IN, or analyzing and calculating an average luminance value of several consecutive frames for example to generate the luminance distribution signal S_A. In other words, the luminance converting unit 405 converts each of the pixel data to a corresponding luminance signal S_L, and the luminance distribution analysis unit 410 generates the luminance distribution signal S_A according to the luminance signals S_L corresponding to different pixels of frames. Therefore, the control unit 415 generates the backlight control signal S_BC according to the average luminance value of each of the frames or the average luminance value (i.e., the luminance distribution result signal) of the several consecutive frames. With different average luminance values, the backlight control signal S_BC controls the backlight module to generate different brightness values. Accordingly, when a certain frame is weak in luminance, the backlight control signal S_BC outputted by the control unit 415 controls the LED driving circuit 125 for example to reduce backlights of the frame; when the frame is strong in luminance, the backlight control signal S_BC controls the LED driving circuit 125 to increase backlights of the frame. Such dynamic backlight control mechanism not only reduces power consumption in applications of a portable electronic device but also refines display effect of real images. In a most simple and intuitive dynamic backlight control mechanism, a backlight source is directly turned off when the whole frame become totally dark, as such approach is also within the scope and spirit of the present invention. For example, by using equations or a look-up table, the control unit 415 generates an appropriate backlight control signal S_BC according to the received luminance distribution signal S_A, and the LED driving circuit 125 generates a corresponding pulse width modulation control signal S_PWM according to the backlight control signal S_BC to drive the LED backlight module 130. In another embodiment, the luminance analysis unit 410 may define several groups corresponding to different luminance values, and determine the luminance distribution signal S_A according to the group within which the luminance corresponding to the luminance signal S_L lies. For that the foregoing image processing circuit 1005 and the backlight control circuit 1010 are built in the timing controller 100, in addition to that a user can adjust/select desired display performance and effect via the timing controller 100 instead of the VGA card 110, the timing controller 100 is also capable of adaptively adjusting backlight effect of a display panel.

Figure 5:
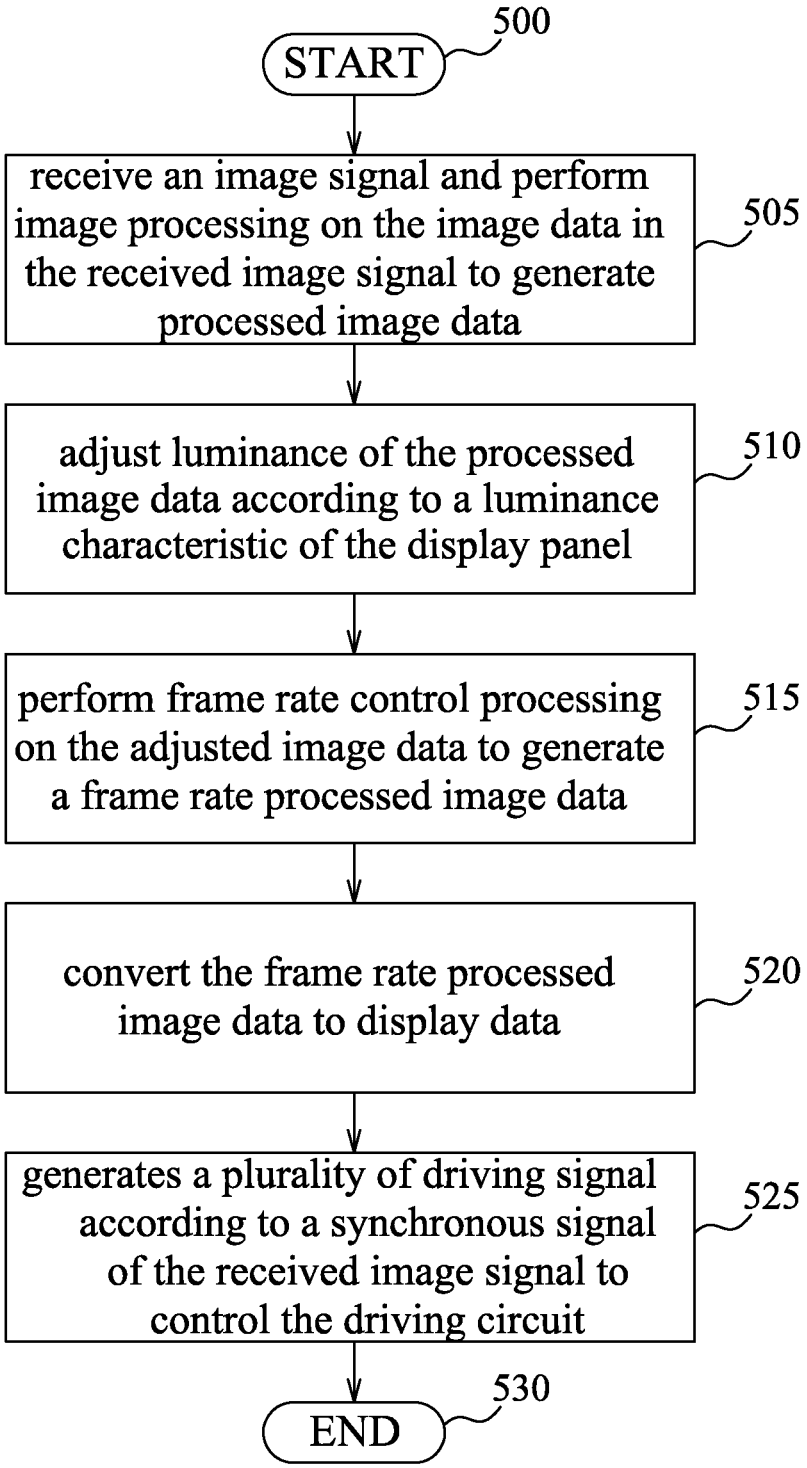
FIG. 5 is a flow chart of generating data S_D and a signal S_C by the timing controller in accordance with the embodiment illustrated in FIG. 1.

Refer to FIG. 5 showing a flow chart of generating a data S_D and a signal S_C by the timing controller 100 in accordance with the embodiment illustrated in FIG. 1. The steps in the flow chart need not be executed as the sequence shown in FIG. 5 nor be successive, provided that the same result is substantially achieved; that is to say, the steps in FIG. 5 can be interleaved with other steps. The steps are described below in detail.

The flow begins with Step 500. In Step 505, the image processing circuit 1005 receives an image signal from the VGA card 110, and perform image processing on the image data S_IN in the received image signal to generate processed image data S_IN'. In Step 510, the luminance adjusting circuit 1015 adjusts luminance of the processed image data S_IN' according to a luminance characteristic of the display panel of the display device 105 to generate adjusted image data S_G. In Step 515, the frame rate control circuit 1020 performs frame rate control processing on the adjusted image data S_G to generate frame rate processed image data S_FRC. In Step 520, the data converting circuit 1025 converts the frame rate processed image data S_FRC to display data S_D to be outputted to the driving circuit 120 of the display panel. In Step 525, the driving signal generating circuit 1030 generates a plurality of driving signals S_C according to a synchronous signal S_E of the image signal to control the driving circuit 120. The flow ends with Step 530.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A timing controller, configured for controlling a driving circuit coupled to a display panel provided with a luminance characteristic and a pixel arrangement, and processing an image signal provided with image data and a synchronous signal, comprising:

an image processing circuit, for processing image data;

a luminance adjusting circuit, for adjusting the processed image data according to the luminance characteristic and generating an adjusted image data;

a data converting circuit comprising a buffer selecting unit configured to select either a first scan line buffer or a second scan line buffer, for converting the adjusted image data to a display data provided for the driving circuit according to the pixel arrangement; and a driving signal generating circuit, for generating a driving signal to control the driving circuit according to the synchronous signal;

wherein the display panel is built in a notebook; and wherein the first scan line buffer is configured for storing adjusted image data for a left half of the display panel and the second scan line buffer is configured for storing adjusted image data for a right half of the display panel.

2. The timing controller as claimed in claim 1, further comprising:

a backlight control circuit, for generating a backlight control signal to control a backlight module of the display panel according to the image data.

3. The timing controller as claimed in claim 2, wherein the backlight control circuit comprises:

a luminance converting unit, for generating a luminance signal corresponding to the image data;

a luminance distribution unit, for analyzing the luminance signal to generate a luminance distribution signal; and a control unit, for generating the backlight control signal according to the luminance distribution signal.

4. The timing controller as claimed in claim 1, further comprising:

a frame rate control circuit, coupled between the luminance adjusting circuit and the data converting circuit, for performing frame rate control processing on the adjusted image data;

wherein, the data converting circuit converts the adjusted image data processed by the frame rate control circuit to the display data.

5. The timing controller as claimed in claim 1, wherein the image processing circuit comprises:

a sharpness adjusting unit, for adjusting sharpness of the image data.

6. The timing controller as claimed in claim 1, wherein the display panel is a liquid crystal display (LCD) device.

7. The timing controller as claimed in claim 1, wherein the image processing circuit comprises:

a six-axis color adjusting unit, for performing a six-axis color adjustment on the image data.

8. A timing control and image processing method, performed for controlling a driving circuit coupled to a display panel provided with a luminance characteristic and a pixel arrangement, and processing an image signal provided with image data and a synchronous signal, comprising:

performing image processing on the image data;

adjusting luminance of the processed image data according to the luminance characteristic;

converting the adjusted image data to display data provided for the driving circuit according to the pixel arrangement and a buffer selection;

generating a driving signal to control the driving circuit according to the synchronous signal; and generating a backlight control signal to control a backlight module of the display panel according to the image data;

wherein the display panel is built in a notebook;

wherein the buffer selection further comprises selecting either a first scan line buffer or a second scan line buffer, and the first scan line buffer is configured for storing adjusted image data for a first half of the display panel and the second scan line buffer is configured for storing adjusted image data for a second half of the display panel; and wherein generating the backlight control signal to control the backlight module of the display panel comprises:

generating a luminance signal corresponding to the image data;

analyzing the luminance signal to generate a luminance distribution signal; and generating the backlight control signal according to the luminance distribution signal.

9. The method as claimed in claim 8, further comprising:

performing frame rate control processing on the adjusted image data to generate frame rate processed image data; and wherein, the step of converting the adjusted image data to the display data further comprises:

converting the frame rate processed image data to the display data.

10. The method as claimed in claim 8, wherein the step of performing image processing on the image data comprises:

adjusting sharpness of the image data.

11. The method as claimed in claim 8, wherein the display panel is an LCD device.

12. The method as claimed in claim 8, wherein the step of performing image processing on the image data comprises:

performing a six-axis color adjustment on the image data.

13. A timing controller, configured for controlling a driving circuit and a backlight module which are coupled to a display panel provided with a luminance characteristic and a pixel arrangement, and processing an image signal provided with image data and a synchronous signal, comprising:

a backlight control circuit, for generating a backlight control signal to the backlight module according to the image data;

an image processing circuit, for processing image data;

a luminance adjusting circuit, for adjusting the image data according to the luminance characteristic;

a data converting circuit comprising a buffer selecting unit configured to select either a first scan line buffer or a second scan line buffer, for converting the adjusted image data to display data provided for the driving circuit according to the pixel arrangement; and a driving signal generating circuit, for generating a driving signal to control the driving circuit according to the synchronous signal;

wherein the display panel is built in a notebook;

wherein the first scan line buffer is configured for storing adjusted image data for a first half of the display panel and the second scan line buffer is configured for storing adjusted image data for a second half of the display panel; and wherein the backlight control circuit comprises:

a luminance converting unit, for generating a luminance signal corresponding to the image data;

a luminance distribution unit, for analyzing the luminance signal to generate a luminance distribution signal; and a control unit, for generating the backlight control signal according to the luminance distribution signal.

* * * * *